United States Patent [19]

Kumon

[11] Patent Number: 4,617,453

[45] Date of Patent: Oct. 14, 1986

[54] THYRISTOR CONTROLLED POWER SOURCE FOR GRADUALLY DECREASING LOADS

[75] Inventor: Seiichi Kumon, Hyogo, Japan

[73] Assignee: Mitsubishi Denki Kabushiki Kaisha, Kobe, Japan

[21] Appl. No.: 723,284

[22] Filed: Apr. 15, 1985

[30] Foreign Application Priority Data

May 22, 1984 [JP] Japan ..... 59-101760

[51] Int. Cl.[4] ..... H05B 1/02

[52] U.S. Cl. ..... 219/501; 219/483; 219/486; 219/508; 323/268; 323/272

[58] Field of Search ..... 219/489, 491, 212, 486, 219/483, 501, 503, 508, 509; 323/239, 245, 267, 268, 271, 272

[56] References Cited

U.S. PATENT DOCUMENTS 2,363,326 11/1944 Hodgkins ..... 219/486

3,668,367 6/1972 Williams ..... 219/486

FOREIGN PATENT DOCUMENTS 58-146435 9/1983 Japan .

*Primary Examiner*—M. H. Paschall

*Attorney, Agent, or Firm*—Bernard, Rothwell & Brown

[57] ABSTRACT

A heating power source device includes a pair of loads connected to a secondary side of a power source transformer by way of four thyristor units. Each of the thyristor units includes pair of thyristors connected in anti-parallel relationship to each other and is controlled so as to connect the loads in parallel relationship to each other at the beginning of energization and then to connect the loads in serial relationship to each other after the resistance of the loads has been reduced below a predetermined level.

2 Claims, 3 Drawing Figures

THYRISTOR CONTROLLED POWER SOURCE FOR GRADUALLY DECREASING LOADS

BACKGROUND OF THE INVENTION

1. Field of the Invention

This invention relates to a heating power source device for an apparatus for heating silicon to grow, and more particularly to a heating power source device adapted to supply a high voltage upon beginning of energization (at an initial part of heating) while it supplies a large electric current toward the end of energization (at a latter part of heating).

2. Description of the Prior Art

Referring to FIG. 1 which is a circuit diagram illustrating a typical one of conventional heating power source devices, a tapped transformer 1 has a primary winding 1*a* and a secondary winding 1*b*, and a pair of thyristor units 2 and 3 each including a pair of thyristors connected in anti-parallel relationship are connected to a high voltage tap and a low voltage tap of the transformer 1, respectively. A load 4 having a negative resistance characteristic such as of silicon is connected to be supplied electric power from the transformer 1 via the thyristor units 2 and 3.

Operations of the heating power source device will now be described. The load 4 presents a high resistance before it is heated, and hence the heating power source device must necessarily provide a high voltage initially. Accordingly, the thyristor unit 2 connected to the high voltage tap of the tapped transformer 1 is turned on to supply a high voltage to the load 4.

The heating power source device is controlled by an output signal from a controlling circuit not shown such that as the load 4 is heated to grow and its resistance becomes lower accordingly, the heating power source device energizes the load with an electric current corresponding to the growth of the load 4. However, as the supply voltage becomes lower, the power-factor becomes lower accordingly. Therefore, when the supply voltage to the load is lowered to a predetermined level, an output signal from the controlling circuit is supplied to the thyristor unit 3 connected to the low voltage tap of the tapped transformer 1 to switch the circuit to turn the thyristor 2 off to energize the load with a good power-factor until the load 4 is grown finally to such a degree as to allow a large electric current to flow therethrough.

Since the typical heating power source device is constructed as described above, while the high voltage tap is required to supply only a low electric current, the low voltage tap is required to supply a high electric current. Accordingly, the heating power source device has a defect that it requires a special transformer as well as high capacity thyristor units for controlling electric currents.

SUMMARY OF THE INVENTION

It is one of principal objects of the present invention to provide a heating power source device which controls an electric current supplied to a load within a limited range over an entire period of energization of the load so as to eliminate the necessity of a special transformer or a high capacity thyristor unit.

In an aspect of the present invention, a heating power source device comprises a heating power source unit connected to a secondary winding of a transformer and including a pair of loads and four thyristor units. The pair of loads are connected in series to each other, and the opposite ends of the serially connected pair of loads are connected to an end of the secondary winding each by way of a thyristor unit. The other end of the secondary winding is connected to one end of the serial circuit of the loads and also to a node of the loads each by way of a thyristor unit. Accordingly, selective combination of on/off states of the four thyristors will allow alternative serial and parallel connections of the two loads.

In another aspect of the invention, a plurality of heating power source units having such a construction as described just above are connected to a secondary winding of a power source transformer, and between each adjacent pair of the heating power source units, an additional thyristor unit or units are provided for serially connecting the loads of the adjacent heating power source units to each other. The additional unit or units are controlled to be turned on when the loads of the adjacent heating power source units are connected in series to the secondary winding of the transformer.

DETAILED DESCRIPTION OF THE PREFERRED EMBODIMENTS

Figure 1:
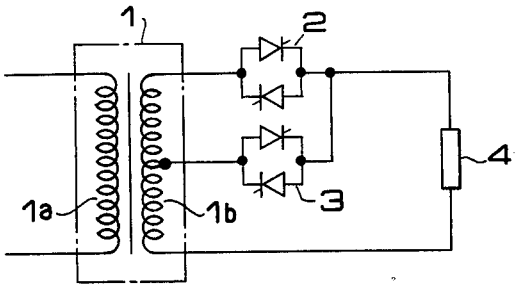
FIG. 1 (PRIOR ART)
FIG. 1 is a circuit diagram showing a typical one of conventional heating power source devices.

Now, a preferred embodiment of the present invention will be described with reference to FIG. 2 in which like parts are designated by like reference numerals to those of FIG. 1.

Figure 2:
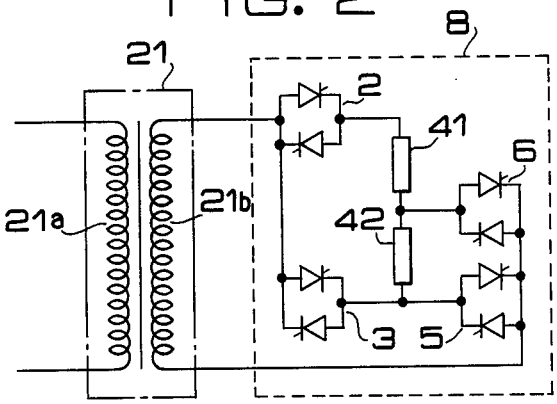
FIG. 2 is a circuit diagram illustrating a heating power source device according to the present invention.

Referring to FIG. 2, a main transformer 21 has a primary winding 21*a* and a secondary winding 21*b*. First and second thyristor units 2 and 3 are connected each at an end thereof to one end of the secondary winding 21*b* of the main transformer 21. Loads 41 and 42 are connected in series between the other ends of the first and second thyristor units 2 and 3. Third and fourth thyristor units 5 and 6, each of which includes a pair of thyristors connected in anti-parallel relationship, have a function as a switch, and the third thyristor unit 5 is connected between a connecting line between the second thyristor unit 3 and the load 42 and the other end of the secondary winding 21*b* of the main transformer 21 while the fourth thyristor unit 6 is connected between a connecting line between the loads 41 and 42 and a connecting end of the third thyristor unit 5 to the second winding 21*b*. The heating power source unit 8 is constituted from such elements as described just above.

Operations of the heating power source unit 8 will be described now. At the beginning of energization, the loads 41 and 42 require a high voltage and a low electric current. At the final stage of energization, a low voltage and a high electric current are required. Accordingly, if the loads 41 and 42 are connected in parallel to each other at the beginning of energization and then in series to each other at the final stage of energization, a load as viewed from the main transformer 21 will be maintained substantially constant over an entire period of energization.

Thus, at the beginning of energization, the thyristor units 2, 3 and 6 are turned on while the thyristor unit 5 is left off to establish parallel connection of the loads 41 and 42 so that a high voltage may be applied to the loads 41 and 42.

Figure 3:
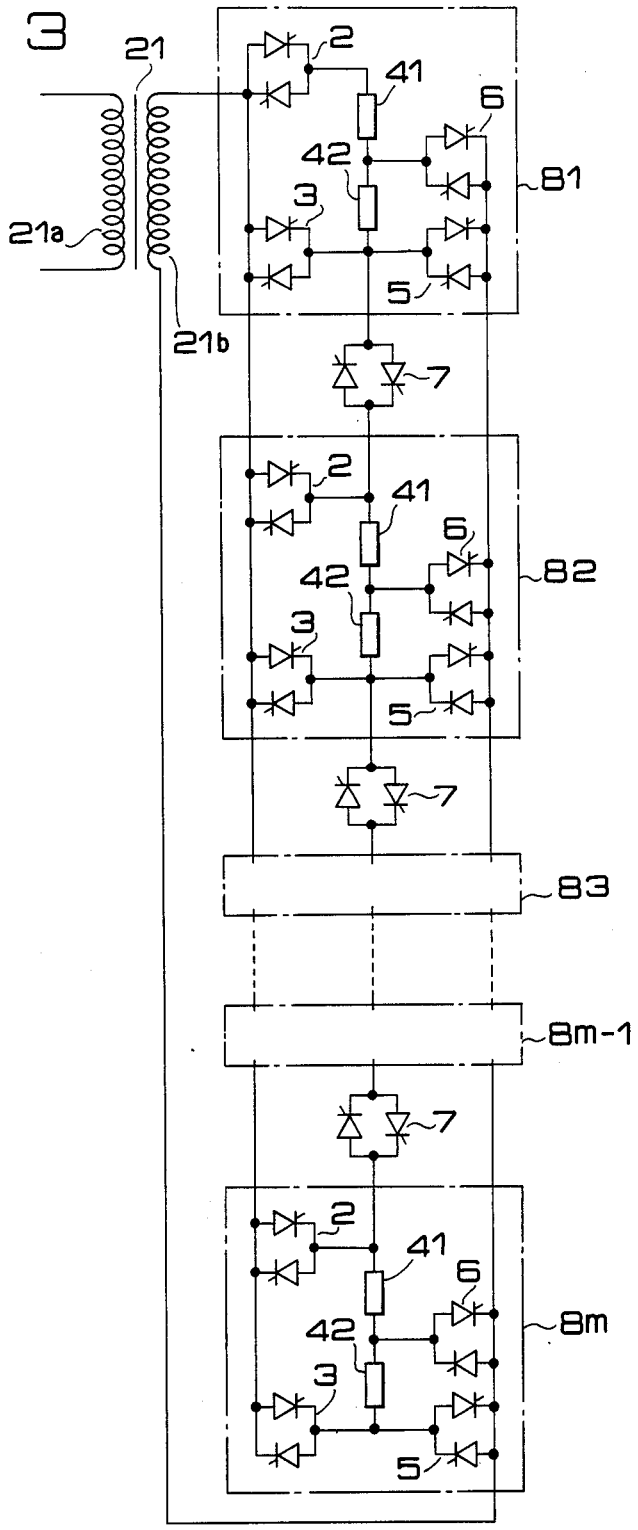
FIG. 3 is a circuit diagram illustrating another heating power source device according to the invention.

As the growth of the loads 41 and 42, which may each be a load having a negative resistance characteristic such as of silicon, proceeds and the resistance becomes lower, the thyristor units 2 and 3 control electric currents in response to an output signal from a controlling circuit not shown to energize the loads 41 and 42 in accordance with the growth of the loads 41 and 42, respectively. When a supply voltage to the loads 41 and 42 is lowered to a predetermined level, the circuit is switched in response to an output signal from the controlling circuit not shown to turn the thyristors 3 and 6 off and the other thyristor units 2 and 5 on to establish serial connection of the loads 41 and 42. Consequently, a voltage as viewed from the power source side becomes twice while an electric current becomes one half, and hence the power-factor is improved thereby. Thus, the loads 41 and 42 are grown until a high electric current finally flows through the loads 41 and 42.

Where two or more pairs of loads are used, connection as shown in FIG. 3 may be employed. Referring to FIG. 3 wherein like parts are designated by reference numerals to those of FIG. 2, heating power source units 81, 82, 83 . . . , 8m-1 and 8m are provided between opposite ends of a second winding 21*b* of a main transformer 21, where "m" indicates an arbitrary positive integral number. Each of the heating power source units has a substantially same construction with the heating power source unit illustrated in FIG. 2, and in each heating power source unit, thyristor units 2 and 3 are connected to one end of the second winding 21*b* of the main transformer 21 while thyristor units 5 and 6 are connected to the other end of the second winding 21*b*. An end of the load 42 of each of the heating power source units 81 to 8m-1, that is, an end of the load 42 which is connected to the thyristor units 3 and 5, is connected, by way of another thyristor unit 7, to an end of the load 41 of the adjacent heating power source unit 82 to 8m, that is, an end of the load 41 to which the thyristor unit 2 is connected. The thyristor units 7 are controlled together with the other thyristors 2, 3, 5 and 6 by a controlling circuit not shown such that they are all turned off when the loads 41 and 42 of all of the heating power source units are to be connected in parallel relationship to one another and all turned on when the loads 41 and 42 of all of the heating power source units are to be connected in serial relationship to one another. While the thyristors 7 may be controlled to be all turned on or off at the same time, it is more advantageous if they are successively turned on in a predetermined order where a large number of heating power source units are connected in common to a single power source transformer. For example, in a condition in which only the thyristor unit 7 connected between the units 81 and 82 is turned on while all of the remaining thyristor units 7 are held off, the loads 41 and 42 of the units 81 and 82 are connected in parallel to one another while the loads of the remaining units are allowed to be connected in serial relationship only within the same units. Such on/off control of the thyristor units 7 enables accurate adjustment of the power-factor.

As apparent from the foregoing description, according to the present invention, a heating power source device is constituted such that, at the beginning of energization, a plurality of loads are connected in parallel relationship to each other so as to allow a high voltage to be applied to the loads, and as an electric current to the loads increases, the loads are successively reconnected in serial relationship to each other. Thus, the present invention is advantageous in that an inexpensive heating power source device having a simple construction can be obtained which eliminates the necessity of a low voltage tap of a transformer for supplying a high electric current and a large capacity thyristor unit and which prevents the power-factor from being lowered from the beginning to the end of energization.

What is claimed is:

1. A heating power source device of the type which includes a heating power source unit connected to a secondary winding of a power source transformer, said heating power source unit comprising:

first and second loads each having first and second ends and having such an electric characteristic that said first and second loads have a high electric resistance at the beginning of energization thereof by said power source transformer and the electric resistance becomes lower as the energization time proceeds, the first end of said second load being connected to the second end of said first load; and four thyristor units each including a pair of thyristors connected in anti-parallel relationship to each other;

a first one of said thyristor units being connected between a first end of said secondary winding of said transformer and the first end of said first load, a second one of said thyristor units being connected between the first end of said secondary winding and a second end of said second load, a third one of said thyristor units being connected between a second end of said secondary winding said the node between said first and second loads, and the remaining fourth one of said thyristor units being connected between the second end of said secondary winding and the second end of said second load;

said thyristor units being individually controlled to be turned on and off so as to connect said first and second loads in parallel relationship to each other at the beginning of energization and then to connect said first and second loads in serial relationship to each other when an electric current to said loads is increased to a predetermined level whereby fluctuation of the electric current to said loads can be minimized over an entire period of energization of said loads.

2. A heating power source device of the type which includes a plurality of heating power source units connected to a secondary winding of a power source transformer, each of said heating power source units comprising:

first and second loads each having first and second ends and having such an electric characteristic that said first and second loads have a high electric resistance at the beginning of energization thereof by said power source transformer and the electric resistance becomes lower as the energization time proceeds, the first end of said second load being connected to the second end of said first load; and four thyristor units each including a pair of thyristors connected in anti-parallel relationship to each other;

a first one of said thyristor units being connected between a first end of said secondary winding of said transformer and the first end of said first load, a second one of said thyristor units being connected between the first end of said secondary winding and a second end of said second load, a third one of said thyristor units being connected between a second end of said secondary winding and the node between said first and second loads, and the remaining fourth one of said thyristor units being connected between the second end of said secondary winding and the second end of said second load;

said heating power source device further comprising at least one fifth thyristor unit which includes a pair of thyristors connected in anti-parallel relationship to each other and is connected between the second end of said second load of one of said heating power source units and the first end of said first load of another heating power source unit;

said thyristor units being individually controlled to be turned on and off so as to connect said first and second loads in parallel relationship to each other at the beginning of energization and then to connect some or all of said first and second loads in serial relationship to each other as an electric current to said loads is increased whereby fluctuation of the electric current to said loads can be minimized over an entire period of energization of said loads.

* * * * *

UNITED STATES PATENT AND TRADEMARK OFFICE

CERTIFICATE OF CORRECTION

PATENT NO. : 4,617,453

DATED : October 14, 1986

INVENTOR(S) : Seiichi Kumon

It is certified that error appears in the above-identified patent and that said Letters Patent is hereby corrected as shown below:

Column 4, line 35, "said" (first occurrence) should be --and--.

Signed and Sealed this

Third Day of March, 1987

*Attest:*

DONALD J. QUIGG

*Attesting Officer*

*Commissioner of Patents and Trademarks*